US011495894B2

(12) United States Patent
Herren

(10) Patent No.: US 11,495,894 B2
(45) Date of Patent: Nov. 8, 2022

(54) RELAY SOCKET

(71) Applicant: COMATRELECO AG, Worb (CH)

(72) Inventor: Daniel Herren, Liebistorf (CH)

(73) Assignee: COMATRELECO AG, Worb (CH)

( * ) Notice: Subject to any disclaimer, the term of this patent is extended or adjusted under 35 U.S.C. 154(b) by 0 days.

(21) Appl. No.: 16/645,978

(22) PCT Filed: Sep. 11, 2017

(86) PCT No.: PCT/EP2017/072755

§ 371 (c)(1),
(2) Date: Mar. 10, 2020

(87) PCT Pub. No.: WO2019/048067

PCT Pub. Date: Mar. 14, 2019

(65) Prior Publication Data

US 2020/0203856 A1 Jun. 25, 2020

(51) Int. Cl.

| | |
|---|---|
| ***H01R 13/639*** | (2006.01) |
| ***H01R 4/48*** | (2006.01) |
| ***H01R 9/26*** | (2006.01) |

(52) U.S. Cl.

CPC ..... *H01R 4/4845* (2013.01); *H01R 4/4827* (2013.01); *H01R 9/2625* (2013.01); *H01R 9/2675* (2013.01); *H01R 13/639* (2013.01)

(58) Field of Classification Search

CPC .. H01R 4/4845; H01R 4/4827; H01R 9/2625; H01R 9/2675; H01R 13/639

See application file for complete search history.

(56) References Cited

U.S. PATENT DOCUMENTS

| | | | | |
|---|---|---|---|---|
| 6,629,852 | B2 * | 10/2003 | Mori | H01R 13/639 439/153 |
| 7,833,047 | B2 * | 11/2010 | Pizzi | H01R 4/4827 439/441 |
| 8,113,858 | B1 * | 2/2012 | Chiang | H01R 13/701 439/188 |
| 8,827,739 | B2 * | 9/2014 | Hanses | H01R 4/4836 439/441 |

(Continued)

FOREIGN PATENT DOCUMENTS

| | | | | |
|---|---|---|---|---|
| DE | 004303717 | A1 * | 8/1994 | H01R 9/2625 |
| DE | 019515358 | A1 * | 12/1995 | H01R 9/2625 |

(Continued)

*Primary Examiner* — Tho D Ta

(74) *Attorney, Agent, or Firm* — Birch, Stewart, Kolasch & Birch, LLP

(57) ABSTRACT

A device (1) for accommodating an electrical or electronic component (400), in particular a relay socket for accommodating a relay, comprises a base body (100) with a receptacle (110) for the component (400). The device (1) also comprises at least one pair (300) of connecting terminals connected to the two electronic connections, wherein the pair (300) of connecting terminals comprises a first connecting terminal (310) for a first connecting wire and a second connecting terminal (320) for a second connecting wire. The first connecting terminal (310) is spaced apart from the receptacle (110) by a first distance in a first direction and the second connecting terminal (320) is spaced apart from the receptacle (110) by a second distance in the first direction, wherein the first distance and the second distance are different.

19 Claims, 3 Drawing Sheets

(56) References Cited

U.S. PATENT DOCUMENTS

| | | | |
|---|---|---|---|
| 2002/0132504 | A1 | 9/2002 | Mori et al. |
| 2014/0213117 | A1 | 7/2014 | Trinh et al. |

FOREIGN PATENT DOCUMENTS

| | | | | | |
|---|---|---|---|---|---|
| DE | 029611543 | U1 * | 7/1996 | ..... | H01R 9/2625 |
| DE | 10045764 | A1 * | 4/2001 | | |
| DE | 202007004414 | U1 * | 5/2007 | ..... | H01R 13/635 |
| DE | 10 2012 010 391 | A1 | 12/2012 | | |
| DE | 102015104268 | A1 | 9/2016 | | |
| EP | 1052731 | B1 | 10/2006 | | |
| EP | 2626879 | A1 | 8/2013 | | |
| FR | 002626879 | A1 * | 8/2013 | ..... | H01R 4/4827 |
| WO | WO 2016/062809 | A1 | 4/2016 | | |

* cited by examiner

RELAY SOCKET

TECHNICAL FIELD

The invention relates to a device for accommodating an electrical or electronic component, in particular a relay socket for accommodating a relay, comprising a base body with a receptacle for the component, wherein the receptacle has, in particular, at least two electronic connections for the component, wherein the device also comprises at least one pair of connecting terminals connected to the electronic connections, wherein the pair of connecting terminals comprises a first connecting terminal for a first connecting wire and a second connecting terminal for a second connecting wire, wherein the first connecting terminal is spaced apart from the receptacle by a first distance in a first direction.

PRIOR ART

Relay sockets for mounting on a mounting rail have been known for many years and are largely mass produced items. Such relay sockets are typically mounted on mounting rails in switch cabinets and serve, in particular, to control machinery, industrial plants or housing technology etc. A relay socket comprises at least two connecting terminals which can be embodied, for example, as screw terminals, spring-cage terminals or leg spring terminals. Leg spring terminals are also referred to as direct connection terminals, since they permit a rigid wire or a wire provided with a wire end ferrule to be connected directly.

A relay socket is disclosed, for example, by EP 1 052 731 B1 (Weidmüller Interface GmbH). A clamping body comprises latching means for latching the clamping body onto a mounting rail. The clamping body comprises an essentially right-angled recess into which a relay component can be inserted. The relay component is secured to the clamping body by an essentially U-shaped pivoting bracket which has two longitudinal limbs and a base limb which is oriented at right angles to the two longitudinal limbs. The clamping body is provided on its upper side with a plurality of pairs of connecting openings for connecting external conductors.

WO 2016/062809 A1 discloses an electronic module which has a base housing with a relay which is plugged in from the upper side. The electronic modules each have a base housing with a plurality of connecting terminals arranged therein.

When electrical installations are refurbished or extended, relays in the switch cabinets or the like are replaced and/or new relays are added. Typically, in this context the total number of relays increases since the electrical installations become more complex. In order to be able to cope with such developments, switch cabinets are preferably over-dimensioned for re-installation. However, the over-dimensioning involves conflicting priorities between the cost and the space required for a larger switch cabinet and a predicted increase in the number of relays over the year. For these reasons, the dimensions of the switch cabinet tend to be initially too small in respect of an overall operating life which can extend over several decades, so that retrofitting with further relays is possible only to a limited extent.

SUMMARY OF THE INVENTION

The object of the invention is to provide a device which forms part of the technical field mentioned at the beginning and has the purpose of accommodating an electrical or electronic component which is of particularly compact design.

The means of achieving the object are defined by the features of claim 1. According to the invention, the second connecting terminal is spaced apart from the receptacle by a second distance in the first direction, wherein the first distance and the second distance are different.

The base body preferably comprises at least two regions, a first region comprising the at least one pair of connecting terminals, and a second region connecting to the first region and comprising the receptacle for the component, in particular the relay.

Said distance results from the shortest connecting line between the first connecting terminal and the receptacle for the component, i.e. in particular from the Euclidean distance.

The receptacle for the component is preferably defined by a surface, typically a rectangular surface in which the component can be accommodated. The receptacle is therefore preferably understood to be that, in particular planar, surface of the device in which the at least two electronic connections are located.

In one preferred embodiment, the preferably planar surface of the receptacle for the component has a first edge and a second edge which is parallel to the first edge, and a third edge and a fourth edge which is parallel to the third edge, wherein the first edge and the second edge have different directions and, in particular, are oriented at a right angle with respect to one another. The pairs of connecting terminals are preferably located between a first plane in which the first edge is located and which is perpendicular to the surface, and a second plane in which the second edge is located and which is perpendicular to the surface.

With respect to the connecting terminals, the distance is preferably measured from a center of the connecting terminal. The center of the connecting terminal is preferably defined by a center point of an entry opening of the connecting terminal into which a connecting wire can be inserted.

Both the first distance and the second distance are measured in the same direction, specifically the first direction, so that the distance vectors of the two distances differ only in absolute value.

In the text which follows, the distance difference is understood to be the absolute value of the difference between the first distance and the second distance.

The distance difference is preferably unequal to zero at least when one of the following distance measurements is carried out:

- The first distance is measured between the first connecting terminal and the third edge, and the second distance is measured between the second connecting terminal and the third edge.
- The second distance is measured between the first connecting terminal and the fourth edge, and the second distance is measured between the second connecting terminal and the fourth edge.

The pair of connecting terminals are understood to be two connecting terminals (the first and the second connecting terminals) which have a relationship with one another. Therefore, in the case of power supply the first connecting terminal can be embodied as a positive pole and the second connecting terminal as an associated negative pole. Furthermore, the two connecting terminals can close a circuit so that the first connecting terminal and the second connecting terminal can close or interrupt a circuit.

In known devices for accommodating an electrical or electronic component, in particular a relay socket, the connecting terminals of the pairs of connecting terminals are each at the same distance from the receptacle of the component, in particular of the relay receptacle. As a result of the fact that according to the invention only the distance between the two connecting terminals of the pair of connecting terminals is different with respect to the receptacle, a more compact design of the device can be achieved in a direction which is different than the first direction. In particular, in this way the overall width of the device or of the base body can be reduced in a second direction at a right angle to the first direction. A plurality of pairs of connecting terminals can be arranged, for example, in a zigzag shape to save material and space, wherein, for example, the respective second connecting terminal of the pairs of connecting terminals can be at a respective smaller distance from the receptacle than the second connecting terminals. Therefore, the pairs of connecting terminals can be, as it were, pushed together in the second direction with smaller width in the second direction with respect to the known embodiments. Even small differences in the distances can already be sufficient to achieve this advantage. Therefore, the distance difference can be selected in such a way that a pair of connecting terminals in the second direction can have a width which corresponds, for example, to twice the diameter of an opening of a connecting terminal.

The compact design is highly significant in particular in the case of relay sockets. Relay sockets are typically mounted on mounting rails. Only a limited number of relay sockets can be mounted on a mounting rail. As a result of a smaller overall width of the relay socket it is therefore possible to mount a relatively large number of relay sockets on a mounting rail. The space requirement is optimized by virtue of the fact that the relay socket now has an overall width in the second direction which, in the case of accommodated relays, corresponds to the relay width in the second direction. In the second direction, the mounting rail is preferably oriented at a right angle to the first direction. In the case of a device which is mounted on the mounting rail, in particular in the case of a relay socket which is mounted on the mounting rail, the first connecting terminal and the second connecting terminal are therefore preferably arranged one next to the other with respect to a longitudinal direction of the mounting rail.

However, it is clear to a person skilled in the art that this advantage also comes into play with other devices for accommodating electrical or electronic components. In any field of electronics and electrical engineering the space requirement plays a large role. Therefore, the device according to the invention can be used in vehicle construction, in particular for example in the construction of automobiles or the like. Therefore, the component can also be embodied as a protective switch, fuse, sensor etc.

The electronic connections for the component, in particular for the relay, are preferably embodied as jacks. Therefore, a relay can easily be installed with plug-type connections in that the relay is plugged into the jack of the receptacle with the plug-type connections.

It is also possible to dispense with the electronic connections. In this case, the component can also be connected by means of separate lines.

The first connecting terminal and the second connecting terminal are preferably arranged one behind the other with respect to the first direction. The term "one behind the other" is understood to mean that in the arrangement of the first and second connecting terminals an overall width of the two connecting terminal openings in the second direction is smaller than the sum of the diameters of the two connecting terminal openings. For this purpose, the distance difference has a value which is equal to or greater than the diameter of a connecting terminal opening of the first connecting terminal or the second connecting terminal. In particular, if the distance difference is greater than the diameter of a connecting terminal opening, the first connecting terminal and the second connecting terminal can in an ideal case be aligned in the first direction so that the smallest possible overall width can be achieved in the second direction. The two connecting terminals can, however, also be slightly offset with respect to the first direction, in particular if this is favorable, for example, for structural reasons.

In variants, it is also possible to dispense with the one behind the other arrangement, in particular if, for example, a zigzag arrangement is selected in which an overall width of a pair of connecting terminals in the second direction corresponds to twice the diameter of a connecting terminal opening (see above).

The first connecting terminal of the pair of connecting terminals preferably comprises a spring for clamping tight the connecting wire. The use of the spring has the advantage that in this way attachment of the connecting wire without tools is made possible. Furthermore, in this way a design which is, in particular, compact with respect to the known screw terminals can be achieved.

In variants, instead of the spring it is also possible to provide different attachment technology for the connecting wire, in particular, for example, a screw terminal or the like. Further technologies are known to a person skilled in the art.

The spring is preferably embodied as a leg spring with a first and a second edge, wherein the first edge projects in a secured fashion into a receptacle space for the connecting wire, and the second spring connects in a sprung fashion into said receptacle space, in order to clamp tight the connecting wire. The receptacle space is here that space which is taken up by the connecting wire in the connecting terminal when the connecting wire is attached. The leg spring is to be particularly preferred, since in this way a connecting wire can be attached directly and without opening a clamping point. Furthermore, the leg spring can be produced cost-effectively. The second edge of the leg spring is for this purpose oriented so as to run toward the connecting wire in the insertion direction of the connecting wire so that the clamping effect is achieved in the opposite direction.

In variants it is also possible to use other types of springs, in particular for example tension springs or the like. In this respect, further types of spring are known to a person skilled in the art.

The leg spring is preferably made of metal, in particular from a metal alloy. The leg spring is particularly preferably a stainless, in particular a steel alloy.

In variants, it is also possible to use separate plastics or composite materials. Further suitable materials for the leg spring are known to a person skilled in the art.

When a connecting wire is clamped tight by the second edge the second edge can preferably be moved at least partially out of the receptacle space. This permits the connecting terminal to be opened and the connecting wire to be released. For this purpose, for example the second edge can be pressed back counter to the spring force. Furthermore, the first edge can be released or moved out of the secured position.

In one variant, this possibility can also be dispensed with. Instead, the connecting terminal can be embodied in such a way that the connecting wire can be removed without releasing the spring from the connecting terminal, for example by means of a sufficiently large pulling force which exceeds the clamping effect of the second edge. Furthermore, a means of guiding the connecting wire can also be embodied in a movable fashion so that the clamping effect of the spring can be deactivated.

Preferably, a duct via which the second edge can be moved at least partially out of the receptacle space by means of a rod-shaped element is arranged in the region of the first spring connecting terminal. Therefore, a mechanism for releasing the connecting terminal is provided which can, on the one hand, be operated easily and, on the other hand, can nevertheless not be activated inadvertently. The duct is preferably arranged in such a way that when a connecting wire is clamped tight by the second edge said duct runs at an acute angle toward the second edge. This ensures that the second edge with the rod-shaped element can be released from the connecting wire with relatively little application of force or that the clamping force of the leg spring can be selected to be relatively large. The duct is preferably dimensioned in such a way that the rod-shaped element does not move into the receptacle space. This prevents a clamping effect being brought about between the rod-shaped element and the connecting wire, thus permitting the removal of the connecting wire to be prevented. For this purpose, the duct can have, for example, a stop for the rod-shaped element.

In variants it is also possible to dispense with the duct. Instead, for example, a permanently installed pushbutton knob or the like, with which the leg spring can be released, can be provided.

The ducts of the two connecting terminals of a pair of connecting terminals are preferably also arranged one next to the other. Furthermore, the ducts are preferably arranged between the first and second connecting terminals. In this way, in the preferred embodiment, the two ducts are arranged in a skewed fashion with respect to one another.

In variants the ducts can however, also be arranged in another way. In particular, the two ducts can also enclose the connecting terminals in the first direction.

The ducts preferably have a duct width in the second direction, wherein the first and second connecting terminals are arranged offset by a channel width with respect to the first direction. This has the advantage that the two ducts can be oriented directly one next to the other and in the first direction. In this case, the duct openings can be arranged one next to the other in the first direction. In this way, a compact design is also achieved in the first direction.

In variants the ducts can also be arranged in other ways. For example, the two ducts can also both be arranged precisely one behind the other in the first direction, as a result of which the one overall width can be further reduced in the second direction. In this case, for example an individual leg spring could be provided, wherein the first limb would project into the receptacle space of the first connecting terminal, and the second limb would project into the receptacle space of the second connecting terminal. In this way, the leg spring would be made from a non-conductive material. Other possible arrangements of the ducts and of the connecting terminals are also known to a person skilled in the art.

The second connecting terminal is preferably embodied in an analogous fashion to the first connecting terminal. The second connecting terminal and the first connecting terminal are preferably of essentially identical design. Therefore, a pair of connecting terminals which is of a particularly simple design is obtained. The term "essentially" is understood to mean that the two connecting terminals correspond in the technically necessary features. For production reasons, it is, however, also possible for differences to arise so that, for example, an asymmetrical reinforcement fin can be formed between the two connecting terminals. Furthermore, a housing can be provided for the two connecting terminals, which housing has, in subordinate aspects, asymmetrical features such as, for example a product number, asymmetrically extending seams between the individual parts or the like, but these do not have any influence on the function.

In variants, it is, however, also possible for the first connecting terminal and the second connecting terminal to be embodied in technically different ways. For example, the ducts can have different angles with respect to the first edge. Furthermore, the receptacle space of the first connecting terminal can differ from that of the second connecting terminal.

The first connecting terminal is preferably arranged point-symmetrically with respect to the second connecting terminal. This arrangement has the advantage that a compact design can be achieved. In particular, if the ducts of the first and second connecting terminals can be arranged one next to the other and between the two connecting terminals, a particularly compact design is obtained here. To a person skilled in the art it is clear that the point symmetry relates to the technically essential features of the connecting terminals, in particular preferably not to production-related features. The essential features comprise the arrangements of the connecting terminal openings, of the receptacle spaces and of the ducts.

In variants the two connecting terminals can also be arranged in a mirror-symmetrical fashion with respect to the essential features.

The pair of connecting terminals with the first connecting terminal and the second connecting terminal is preferably embodied as a separate unit from the base body. This has the advantage that the pair of connecting terminals can be produced cost-effectively as a mass-produced item for different devices, in particular relay sockets. In this way, with the same pair of connecting terminals it is possible to equip relay sockets with a different number of pairs of connecting terminals.

In variants it is also possible to embody a plurality of pairs of connecting terminals as one unit which is separate from the base body. In particular, a plurality of pairs of connecting terminals can be connected, for example, via predetermined break points so that according to requirements a number of pairs of connecting terminals can be disconnected from the plurality of pairs of connecting terminals. It is ultimately also possible to dispense with the embodiment of the pairs of connecting terminals as a separate unit. In this case, the connecting terminals can also be embodied in one piece with a housing of the device, in particular the base body.

The pair of connecting terminals is preferably embodied as a plug-in unit which can be plugged, in particular latched, into the base body. In this way, the manufacturer of the device is simplified further. In order to increase the variability, cover panels can also be provided for the plug-in locations in the base body, as a result of which plug-in locations which are not occupied by pairs of connecting terminals can be covered.

In variants, the pairs of connecting terminals can also be connected in other ways to the base body, for example by bonding, screwing, etc. Further variants for mounting the pairs of connecting terminals are known to a person skilled in the art.

The pair of connecting terminals preferably comprises two half-shells which can be produced by means of an injection molding method. In this way a cost-effective production method is obtained.

In variants it is also possible to use other production technologies such as, for example, deep drawing or the like.

One arrangement comprises at least two devices and a mounting rail, wherein the devices are mounted parallel to one another on the mounting rail, and wherein the first direction is oriented at a right angle to a longitudinal direction of the mounting rail, and wherein two adjacent devices are in contact with one another, in particular over an area.

As a result, in comparison with known systems for attaching an electrical or electronic component in a receptacle, a more compact design is achieved at least in the second direction, since the device can accommodate more pairs of connecting terminals per unit of length in the second direction by virtue of the compact embodiment of the pairs of connecting terminals. In this case, the overall width is preferably understood to be an average width of the device when a plurality of devices are arranged one next to the other in the second direction. In particular if the devices are embodied so as to be capable of being plugged together in the second direction, projections can be present in the second direction, which projections are accommodated in a recess of an adjacent device. In this case, the projection or the projections is/are not to be considered as adding to the overall width of the device.

The overall width or the receptacle width of the device can be embodied differently so that for a different number of pairs of connecting terminals or else different relay widths there can also be different devices for accommodating them. For example, devices, in particular relay sockets with an overall width of 11 mm, 14 mm, 17 mm, 22 mm, 22.5 mm, 25 mm, 35 mm etc. can be provided, in particular depending on the desired number of pairs of connecting terminals. A height of the device can also be here, for example, approximately 110 mm and, a depth transverse to the second direction can be approximately 100 mm.

It is clear to a person skilled in the art that basically any desired overall widths can be provided. Depending on the field for application, the overall widths can also be significantly smaller, for example a few millimeters, or can also be significantly larger, for example several centimeters up to decimeters. Correspondingly, a height and a depth of the device can also vary.

When a plurality of devices are arranged one next to the other, in particular on a mounting rail, it is therefore possible to provide a particularly compact arrangement. In particular, in this way it is possible to maximize a total number of devices given a predefined length of the mounting rail.

The devices in the arrangement one next to the other are preferably in contact over an area so that a compact arrangement is provided. However, the devices do not have to necessarily be in contact over an area here. Depending on the design of the devices, they can also merely be in contact over an edge region. Furthermore, the devices can also be embodied in such a way that they can be plugged together, wherein a projection of a first device engages or latches into a recess in the adjacent device. If appropriate, under certain circumstances for technical reasons (e.g. the grid of the mounting rail for the devices), an arrangement at a short distance e.g. 1 mm, can also be provided. However, the devices are arranged in as close a contact as possible on the mounting rail.

The device preferably has a mounting device for mounting on a mounting rail, wherein when the device is mounted on the mounting rail the first direction is oriented in a longitudinal direction of the mounting rail. By means of the mounting device it is preferably possible to arrange a plurality of devices in a row one next to the other on a mounting rail. The mounting device is particularly preferably arranged in such a way that the device can be mounted on the mounting rail but can also be released from it.

In variants it is also possible to dispense with the mounting device.

The mounting device preferably comprises a longitudinal groove which is oriented parallel to the second direction. In one particular embodiment, the longitudinal groove can comprise latching elements with which the device can be mounted on the mounting rail.

In variants, instead of the longitudinal groove or in addition thereto it is possible to provide other attachment means such as, for example, a screw connection, bonded connection etc.

The mounting rail is preferably a cap rail, in particular a cap rail according to the DIN standard.

In variants the mounting rail can also be embodied in a different way, and in particular for example comprise a rectangular shape, a U shape or a T shape or the like in cross section.

The holding means preferably has a holding means width in the second direction, wherein the holding means width is less than or equal to the receptacle width. The holding means is preferably arranged laterally with respect to the receptacle in terms of the second direction. As a result of the fact that the holding means has the same or a smaller width than the receptacle, the device can be kept compact as a whole.

In variants the holding means width can also be embodied to be larger than the receptacle width. In this case, the holding means can be embodied in such a way that a plurality of receptacles of a plurality of devices comprise a common holding means which extends over the plurality of receptacles.

The holding means is preferably embodied in a pivotable fashion, wherein in a first pivoted state of the holding means the receptacle is released and in a second pivoted state, different from the first, of the holding means a component can be held in the receptacle. Depending on the arrangement and dimension of the holding means, a pivoting angle between the first and second pivoted state can be selected to be different. The holding means can be pivotable, for example, over a small angle of a few degrees such as, for example, between 2° and 10° ranging up to relatively large angles of 180° or more. Depending on the design of the device, angles in the region of 45°, 90°, 135° etc. can also be conceivable. As a result of the pivotability, a structurally particularly simple holding means is provided. A proximal end of the holding means is preferably connected to the base body in a pivotable fashion.

The holding means can have different shapes for this purpose. The holding means can be, for example, essentially rod-shaped and therefore hold the component only on one side (e.g. by means of a latching nose, see below). Furthermore, the holding means can also be L shaped and therefore hold the component from above. The L-shaped holding means can for this purpose latch, for example, on the base body in the second position. The holding means can comprise, for example, a U-shaped bracket which can be attached on both sides of the base body transversely with respect to the second direction, for example by means of a snap-action closure, a screw connection, a latching connection or the like.

In variants the holding means can also be held in a non-pivotable fashion. In this case, the holding means can be embodied, for example, so as to be elastically deformable, in particular bendable. Furthermore, the holding means can also be deformable in a plastic and/or elastic fashion. For example, the holding means can comprise a rubber, in particular a rubber band or the like, wherein the component can be clamped tight in the receptacle. Furthermore, a non-elastic band can be provided as a holding means, in particular for example a band with a touch and close fastening or the like.

The holding means is preferably mounted on the base body so as to be pivotable in a plane at a right angle to the second direction. The holding means comprises for this purpose preferably approximately a C-shaped hinge region, where an engagement can occur behind a region of the base body. This region of the base body can for this purpose have two aligned drilled holes arranged opposite one another, into which drilled holes the C-shaped hinge region of the holding means can latch. Instead, a hinge region can also be provided which is embodied in an essentially T-shaped fashion, wherein two aligned drilled holes are formed in the base body, which drilled holes are directed opposite with respect to one another. Furthermore, the hinge region can also comprise an axle which can latch into latching receptacles of the base body. Furthermore, the holding means can also be connected to the base body by means of a tape, in particular an adhesive tape or the like. Further possibilities for forming a hinge are also known to a person skilled in the art. In particular, the parts of the hinges between the holding means and the base body can also be interchanged in the above enumeration (e.g. the axle can also be formed on the base body, wherein the latching receptacle is provided on the holding means).

In variants, the holding means can also be embodied so as to be pivotable itself. For this purpose, the holding means can be embodied in two parts, with a distal region and a proximal region, wherein the distal region is connected in a pivotable fashion to the proximal region. The connection can be embodied, for example, as a hinge, in particular as a simple hinge (rolled), as a rod hinge, as a film hinge, as a hinge as mentioned above or the like. As has already been explained above, it is also possible to dispense with the pivotability of the holding means, in particular if instead a plastically and/or elastically deformable holding means is provided.

The holding means preferably comprises a pivotable lever with a latching hook for latching into a notch in the component. Therefore in this way, the component, in particular a relay, can be held in a particularly simple way in the receptacle of the device, in particular the relay socket. By embodying the holding means as a pivotable lever with a latching hook in addition a structurally particularly simple holding means which can be manufactured cost-effectively is provided. As a result of the fact that the component is held with a latching hook, a holding means which is particularly easy to operate is also made available. The latching hook can be embodied in such a way that a correct closed state can be detected haptically. Furthermore, a holding means which is particularly easy to release is obtained by means of the use of the latching hook, wherein the component can be released quickly and efficiently from the receptacle of the device.

In variants the lever can also comprise a different closing element instead of the latching hook. For example, the lever of the holding means can also comprise a loop which can be laid over a projection or a knob. It is also conceivable to embody the holding means in such a way that instead of being able to latching onto the component they can latch onto the base body of the device in order to hold the components in the receptacle. For this purpose, for example a latching connection analogous to a cable tie, in particular a disposable or reusable cable tie can be provided. Any desired number of variants in this respect are known to a person skilled in the art.

The lever preferably has an elastic region. The closing element, in particular for example the latching hook can therefore be latched in by means of stretching of the elastic region. For this purpose, the elastic region can be formed on the closing element itself, wherein, for example, the latching hook is embodied in an elastic fashion.

In variants the lever can also be mounted on an elastic element of the base body. Furthermore, it is also possible to dispense with the elastic region.

A spring effect of the elastic region is also directed at least in a longitudinal direction of the lever. The elastic region is particularly preferably arranged for this purpose between the base body and the latching hook, so that the latching hook can be hooked into the notch of the component by means of a pulling movement on the lever. If the holding means does not have a latching hook, the elastic region is preferably also arranged between the base body and the attachment element of the holding means so that a pulling force on the component can be transmitted between the base body and the attachment element.

In variants the elastic region can also be oriented transversely with respect to a longitudinal direction of the lever. In this case, the holding means can be embodied in a bendable fashion, wherein it can hold a component, for example, in the position of rest or approximately in the position of rest, in order to achieve a stable position of the holding means.

The elastic region preferably comprises a U shape in an elastic material, wherein an opening direction of the U shape is oriented at a right angle to the longitudinal direction of the lever. In this way, a particularly simple implementation of the elastic region is achieved. In particular, in this way a holding means can be formed from a non-stretchable but bendable material such as, for example metals, such as steel or metal alloys or non-stretching plastics. The U shape of the elastic region also has the advantage that in this way both a sprung movement of the latching hook (or some other type of attachment element) in the longitudinal direction of the vehicle as well as a movement transversely with respect to the longitudinal direction of the lever is made possible so that the latching hook can be hooked into the notch in the component both by means of a pulling movement in the longitudinal direction of the lever and by means of a pivoting movement. Instead of a single U shape, a zigzag shape or wave shape or the like can also be provided.

In variants it is also possible to dispense with the U-shaped region. The elastic region can also be implemented merely by a suitable selection of material for the holding means or part of the holding means. Furthermore, in order to obtain the elastic region the holding means can have a Z shape or further shapes which deviates from a straight line. The elastic region can also be obtained by means of a spring, in particular a tension spring or the like.

The holding means preferably comprises a polyamide and/or a polyester, in particular a polycarbonate, and is preferably embodied in one piece. The use of plastics for the holding means has the advantage that it can easily be produced in large quantities and cost-effectively, for example by means of a casting method. Furthermore, the use of plastics has the advantage that they are electrically insulating. In particular in the case of electrical or electronic systems it is a particular advantage if components which do not have to be current-conducting are embodied in an insulating fashion. The single-piece embodiment of the holding means also permits cost-effective production of the holding means and therefore of the device as a whole.

In variants it is also possible to provide other materials for the holding means. For example, the holding means can be made from metal, preferably from steel or from a steel alloy and, in particular, from sheet metal. The holding means can also be produced efficiently by means of a punching process and bending process. Depending on the alloy, particular advantages can be obtained during the spring effect, for example better properties with respect to material fatigue in comparison to plastics. Depending on the embodiment of the holding means it is, in particular, also possible to provide a tape, in particular a textile tape with a touch and close fastening, a rubber band etc.

The holding means preferably has at one distal end a gripping region for activating the holding means. In this way, particularly ergonomic activation of the holding means is made possible. The holding means can be gripped at the gripping region and moved between a closed state and an opened state. When there is a pivoting lever with a latching hook and elastic region the gripping region is preferably arranged in a distal fashion with respect to the latching hook. The elastic region can be pulled into its length at the gripping region, or the lever of the holding means can be bent back in order to allow the latching hook to latch into the notch in the component. The gripping region can, however, also be arranged between the latching hook and the base body.

In variants it is also possible to dispense with the gripping region.

The holding means is preferably embodied in such a way that it is possible to provide a label with which the relay socket or the relay can be identified. In variants it is also possible to dispense with the possibility of providing a label.

Further advantageous embodiments and combinations of features of the invention result from the following description of details and the entirety of the patent claims.

BRIEF DESCRIPTION OF THE DRAWINGS

In the drawings which are used to explain the exemplary embodiment.

Basically, identical parts are provided with the same reference symbols in the figures.

WAYS OF IMPLEMENTING THE INVENTION

Figure 1:
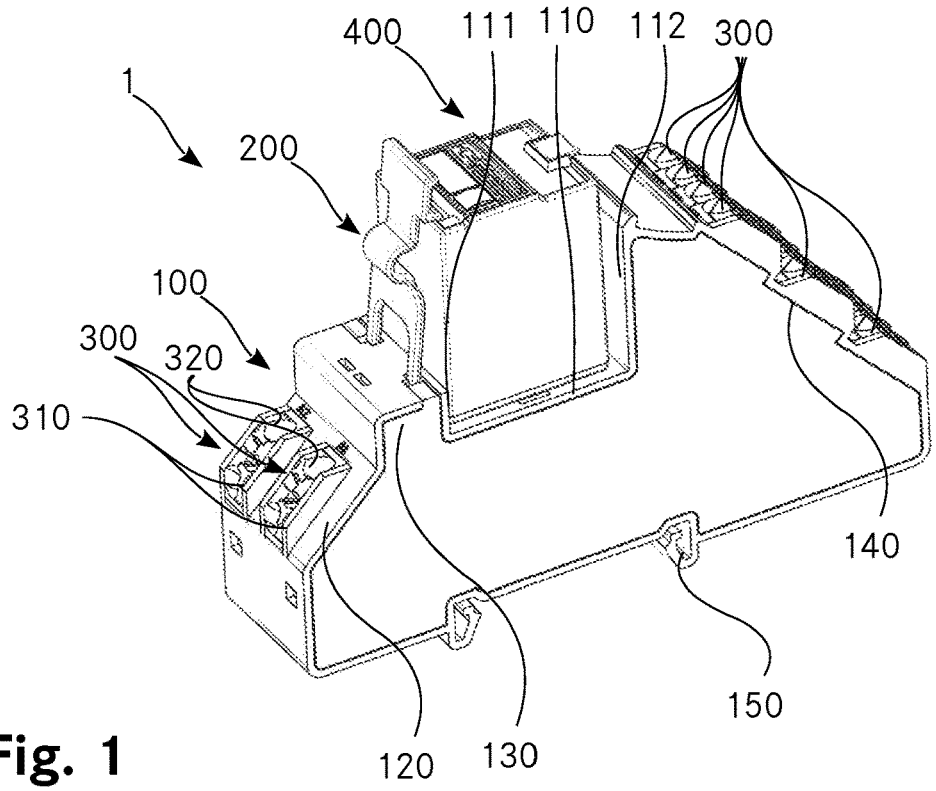
FIG. 1 shows a schematic oblique view of a device which is embodied as a relay socket, wherein a relay is held in the receptacle by means of a pivoting lever.

FIG. 1 shows a schematic oblique view of a device which is embodied as a relay socket 1, wherein a relay 400 is held in the receptacle 110 of the base body 100 by means of a holding means which is embodied as a pivoting lever 200.

The relay socket 1 has an essentially prismatic shape in the second direction. The second direction defines a width of the relay socket 113. On an underside, the relay socket 100 has a mounting device for a cap rail (not illustrated). It is preferably a mounting device 150 for commercially available cap rails according to the DIN standard, for example according to the standard EN 50022-35. The mounting device 150 is essentially embodied as a groove for receiving the cap rail, and has latching strips which can engage in a latching-in fashion behind a flange of the cap rail on the groove edge. The receptacle 110 of the base body 100 is embodied essentially in a U shape and is open in each case in the second direction. The U-shaped receptacle 110 is embodied in an asymmetrical fashion so that the two side walls 111 and 112 differ in height.

The receptacle 110 is enclosed by two oblique faces 120 and 140 which rise toward the receptacle 110 and in which pairs 300 of connecting terminals for connecting the relay 400 are arranged. The two connecting terminals 310, 320 of a pair 300 of connecting terminals are arranged one behind the other with respect to the first direction. This is illustrated in an exemplary fashion with the two pairs 300 of connecting terminals of the oblique face 120. This permits a particularly narrow design of the base body 100 and therefore of the relay socket 1 in the second direction, as a result of which in turn more relay sockets per unit of length can be arranged, in particular on a cap rail. A shorter oblique face of the oblique faces 120 with two pairs 300 of connecting terminals ends at a height of the receptacle 110.

As stated above, in these two pairs 300 of connecting terminals the two connecting terminals 310 and 320 are arranged one behind the other with respect to the first direction. However, it is clear to a person skilled in the art that under certain circumstances one of the two oblique faces determines the width of the base body in the second direction—here this is the oblique face 140—owing to the number of pairs of connecting terminals. In this way, the connecting terminals 310 and 320 of the two pairs 300 of connecting terminals of the oblique face 100 could, under certain circumstances, also be arranged one next to the other with respect to the first direction without the overall width of the base body being thereby made larger in the second direction.

The oblique face 120 is adjoined by a cuboid base 130. An inner side of the base 130 is defined by the first side wall 111 of the U-shaped receptacle 110 for the relay 400. The receptacle 110 itself comprises a plurality of electrical connecting jacks for the relay 400, which are electrically connected to the pairs 300 of connecting terminals. The second side wall 112 which lies opposite the first side wall 111 is made higher than the first side wall 111. The second side wall 112 adjoins the second oblique face 140 in which 12 pairs 300 of connecting terminals are arranged.

The base 130 bounds the receptacle 110 for the relay 400 at a right angle to the second direction. In this embodiment, a pivoting lever 200 is connected in a pivotable fashion to the base 130. For this purpose, the base has two openings in the cover, behind which two holding bolts 211 of the pivoting lever 200 engage.

The pivoting lever 200 is therefore mounted in a pivotable fashion on the base 130. In order to attach a relay 400, the pivoting lever 200 is transferred from an open position into a closed position, wherein the latching strip 230 of the pivoting lever 200 latches into a notch in the relay 400 and therefore holds it in the receptacle 110.

It is clear to a person skilled in the art that the relay 1 shown is intended to show the arrangement of the pairs 300 of connecting terminals merely by way of example. The shape and size of the relay 1 can be largely as desired here. In particular, instead of two oblique faces it is also possible for there to be one oblique face or more than two, in particular three or four oblique faces.

Furthermore, instead of oblique faces it is also possible to provide horizontal faces (parallel to the first and second direction) or vertical faces (at a right angle to the first direction) for accommodating the pairs 300 of connecting terminals.

Figure 2:
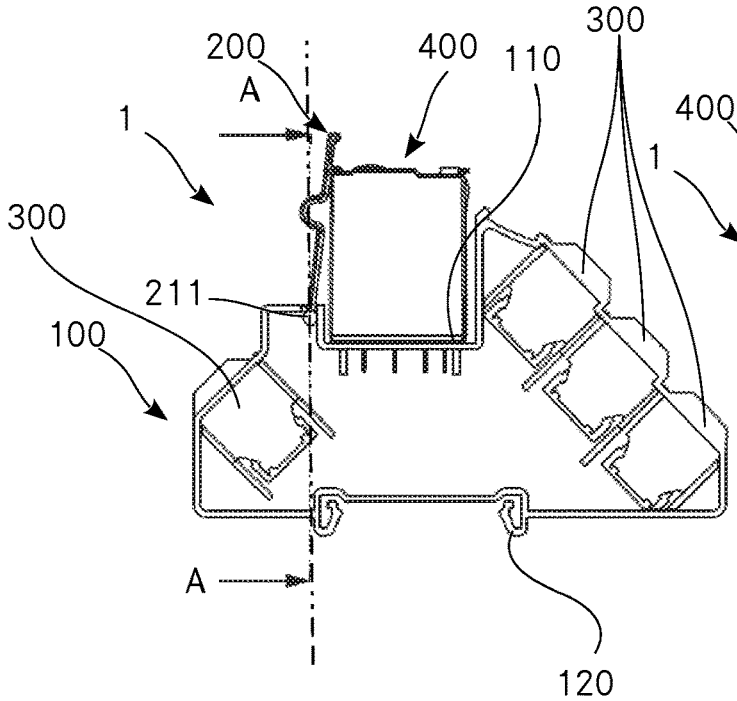
FIG. 2 shows a schematic sectional illustration through the relay socket according to FIG. 1 along a plane at a right angle to the second direction.

FIG. 2 shows a schematic sectional illustration through the relay socket 1 according to FIG. 1 along a plane at a right angle to the second direction. It is apparent here that the holding bolts 211 lie underneath the cover of the base 130. Furthermore, the plug-in connections of the relay 400 are apparent within the plug-in jacks of the receptacle 110. The electrical connections between the pairs 300 of connecting terminals and the plug-in jacks are not illustrated for the sake of better clarity.

Figure 3:
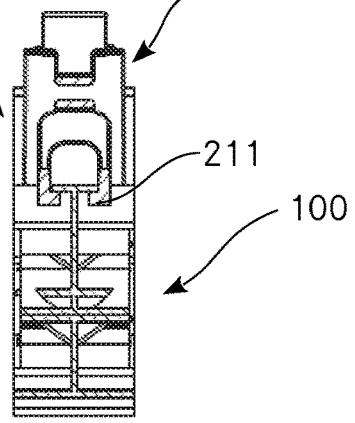
FIG. 3 shows a schematic sectional illustration through the pivoting lever along the line A-A in FIG. 3.

FIG. 3 shows a schematic sectional illustration through the relay socket, in the plane of the pivoting unit 200 along the line A-A in FIG. 2. In this figure it is apparent that the two holding bolts 211 engage behind the cover of the base 130.

Figure 4:
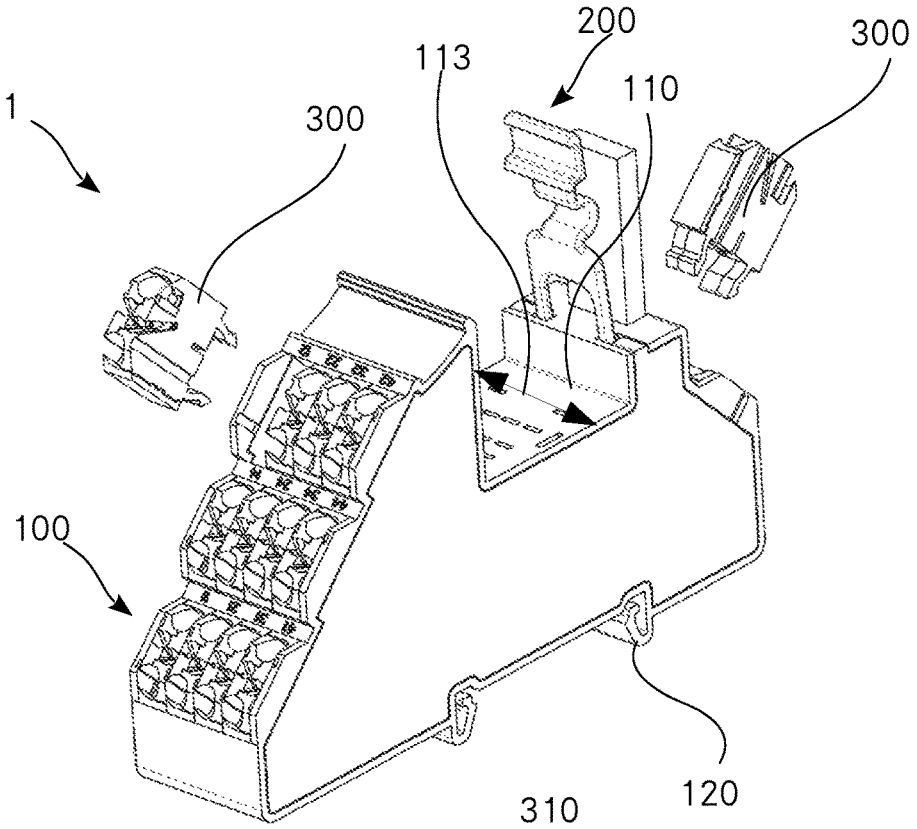
FIG. 4 shows a schematic oblique view of a relay socket with connecting terminals for connecting wires.

FIG. 4 shows a schematic oblique view of a relay socket with pairs 300 of connecting terminals for connecting wires. The pairs 300 of connecting terminals are embodied here as elements which can be plugged in and which are latched into receptacles of the base body 100. This is illustrated by way of example by two connecting terminals 300 which are illustrated outside the base body 100, in particular directly before the plugging into the base body 100. The latching arrangement can either be releasable here, which permits defective pairs 300 of connecting terminals to be replaced, or non-releasable, which, where appropriate, permits higher safety standards to be complied with.

Figure 5:
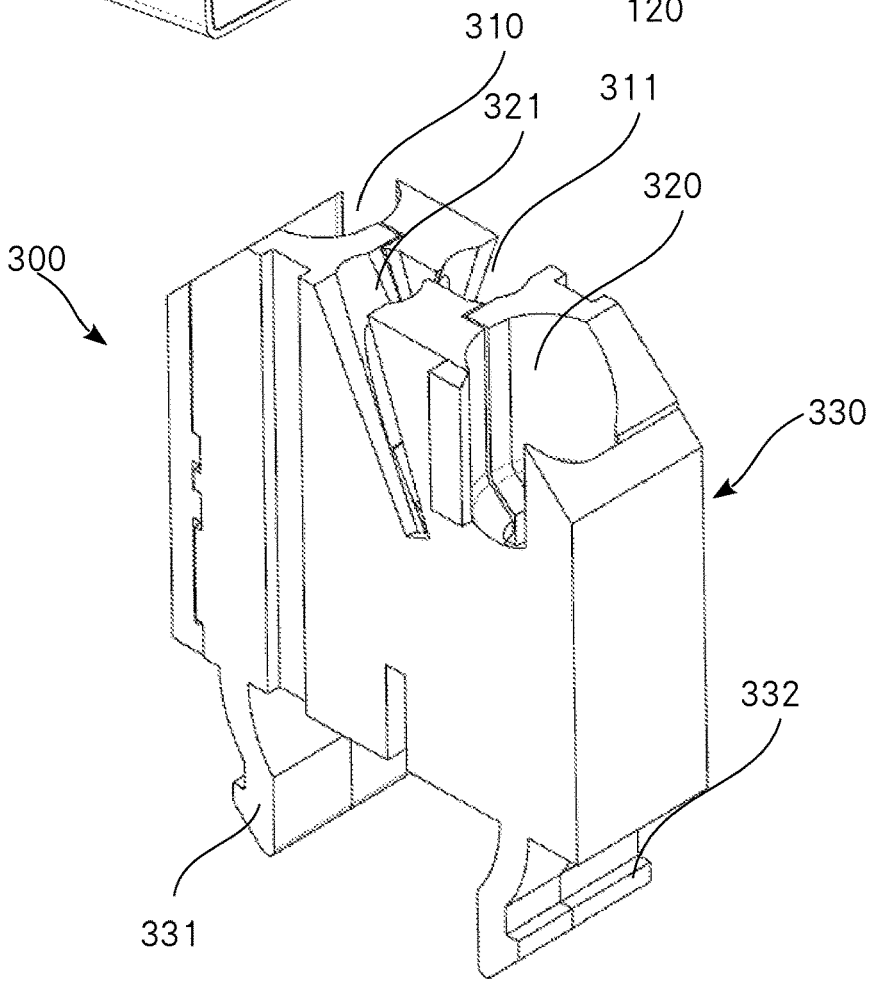
FIG. 5 shows a schematic oblique view of a pair of connecting terminals.

FIG. 5 shows an enlarged schematic oblique view of a pair 300 of connecting terminals with a first connecting terminal 310 and a second connecting terminal 320. The pair 300 of connecting terminals is embodied here as an essentially cuboid plug-in unit. The pair 300 of connecting terminals has a two-part housing 330. The housing 330 comprises a first duct 311 which is assigned to the first connecting terminal 310, and a second duct 321 which is assigned to the second connecting terminal 320. When the connecting wire 500 is plugged into the first connecting terminal 310 or second connecting terminal 320, the connecting wire 500 can be released from the terminal by introducing a pin 600 into the assigned duct 311 or 321 (see FIG. 7 below). Opposite the openings of the connecting terminals 310, 320, the housing 330 comprises latching projections 331, 332 which can be latched into the base body 100 of the relay 1.

Figure 6:
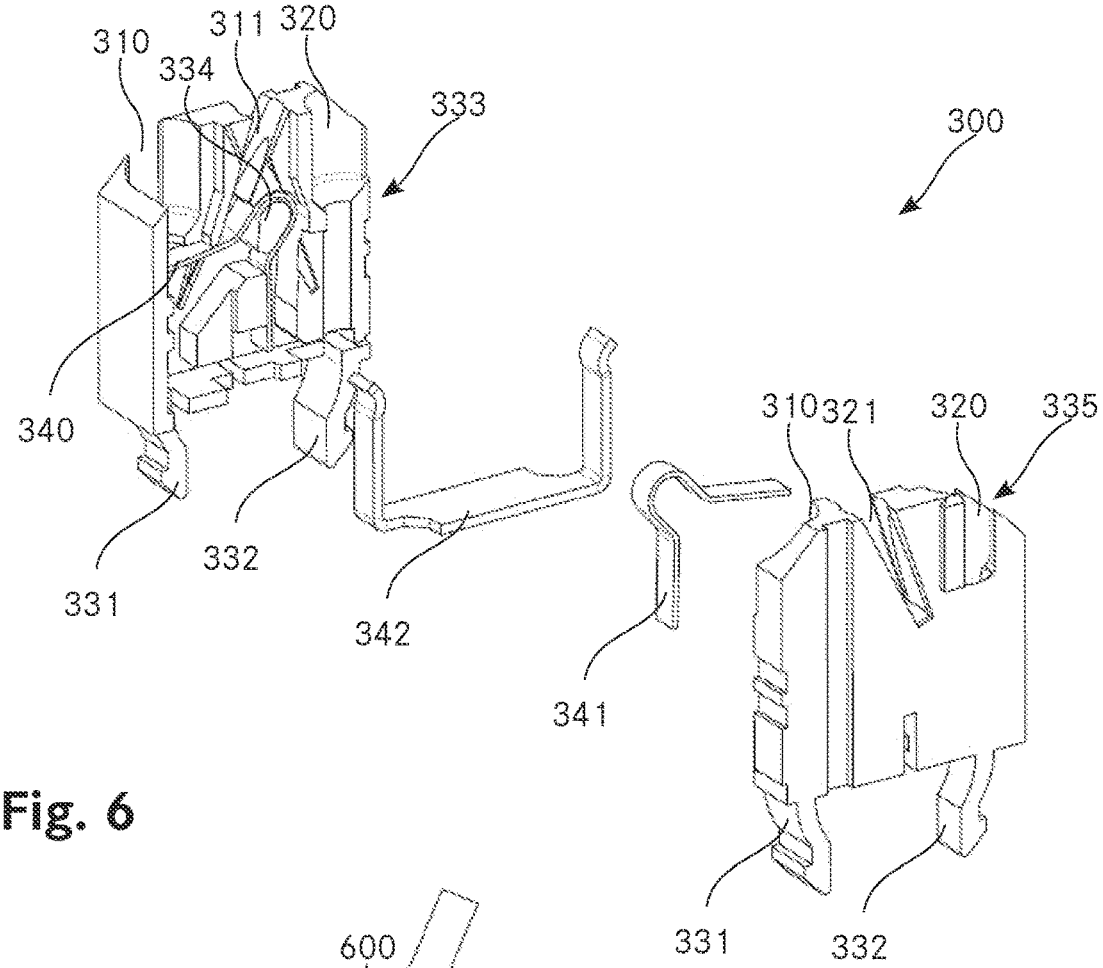
FIG. 6 shows an exploded illustration of the pair of connecting terminals according to FIG. 5.

FIG. 6 shows an exploded illustration of the pair 300 of connecting terminals according to FIG. 5, wherein the inner design of the pair 300 of connecting terminals is apparent. The two connecting terminals 310, 320 each comprise a receptacle for the connecting wire. The receptacles are oriented parallel to one another here, but in another embodiment they can also enclose an angle with respect to one another. In the interior of the half-shell 333 there is a spigot 334. The spigot 334 receives a neck of a leg spring 340. A first limb of the leg spring 340 is attached to a stop of the housing 330, and the second limb projects into the interior of the receptacle of the connecting terminal 310. In the present embodiment, when the connecting wire 500 is not introduced this limb is oriented essentially at a right angle to the receiving direction (direction of an introduced connecting wire 500). It is also apparent that the duct 311 is directed at an acute angle toward the second limb so that when a pin introduced the second limb of the leg spring 340 can be guided out of the receptacle space of the connecting terminal 310 in order to release the connecting wire.

The second half-shell 335 is of identical design and correspondingly receives a second leg spring 341. Finally, the pair 300 of connecting terminals comprises a U-shaped bracket 342, wherein in the mounted state the distal ends each project into one of the receptacles of the connecting terminals 310 or 320.

Figure 7:
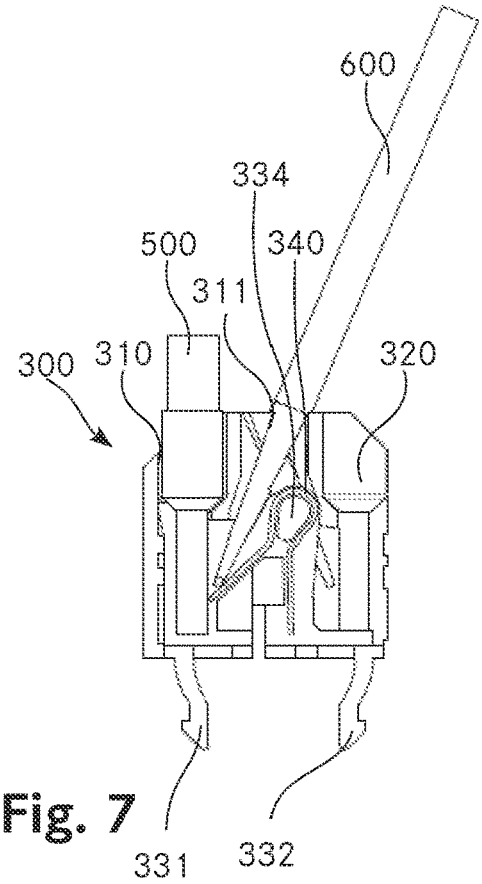
FIG. 7 shows a schematic side view of a half-shell of the pair of connecting terminals with an introduced connecting wire and an inserted pin.

FIG. 7 finally shows a schematic side view of the half-shell 333 of the pair 300 of connecting terminals with the connecting wire 500 inserted and the pin 600 introduced. The introduction of the connecting wire 500 into the connecting terminal 310 pulls back the second limb of the leg spring 340 counter to the spring force. In this way, the second limb of the leg spring 340 encloses an acute angle with the connecting wire 500 and clamps it tightly. Through the introduction of the pin 600 into the duct 311 the second limb of the leg spring 340 is bent out of the receptacle space of the connecting terminal 310 counter to the spring force, so that the connecting wire 500 is released.

It is apparent to a person skilled in the art that the present exemplary embodiment of the connecting terminals is merely an exemplary embodiment. Instead of the leg spring it is also possible to use other springs which are known to a person skilled in the art. Furthermore, screw terminals or the like can also be provided.

Figure 8:
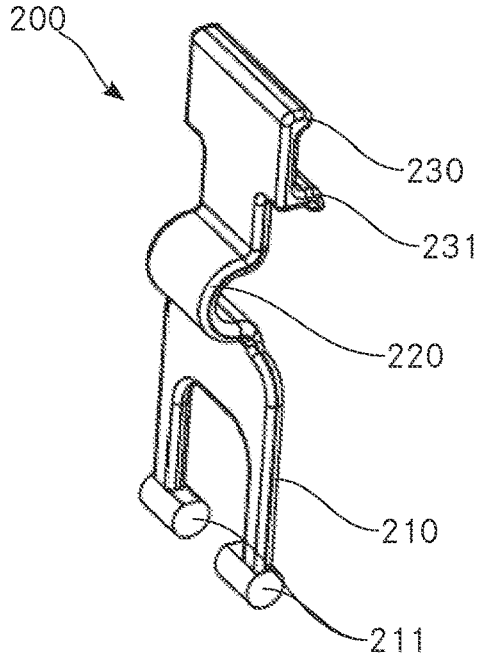
FIG. 8 shows a schematic oblique view of a pivoting lever according to FIG. 1.

FIG. 8 shows a schematic oblique view of a pivoting lever 200 according to FIG. 1. The pivoting lever 200 comprises essentially three regions. In the proximal area the pivoting lever comprises a fork region 210 with two prongs which end in one holding bolt 211 each. The holding bolts 211 are directed inward with respect to the prongs of the fork region 210 and are spaced apart from one another. The holding bolts 211 serve to pivotably mount the pivoting lever 200 on the base body 100. At the ends of the fork region 210 lying opposite the holding bolt 211 there is an adjoining spring region 220 or an elastic region 220. In the present first embodiment the spring region 220 is formed by a U shape in the pivoting lever whose opening is oriented at a right angle to a longitudinal direction of the pivoting lever. A gripping region 230, which ends in a gripping part for gripping the pivoting lever, adjoins the spring region 220. The latching region 230 comprises a latching strip 231 which is oriented at a right angle to the longitudinal direction of the pivoting lever. In the closed state, the latching strip 231 engages in a notch in the relay and holds it in the receptacle 110 (see FIG. 1).

In the present first embodiment, the latching lever 200 is embodied in one piece. Basically, the pivoting lever can be composed of any desired material, but preferably a plastic, in particular a polyamide or a polycarbonate is used. The pivoting lever 200 can therefore be manufactured with an injection molding method. In summary it is to be noted that according to the invention a device for receiving an electrical or electronic component, in particular a relay socket, is provided which is particularly space-saving.

The invention claimed is:

1. A relay socket for accommodating component relay comprising a base body with a receptacle for the relay, wherein the receptacle has at least two electronic connections for the relay, wherein the relay socket also comprises at least one pair of connecting terminals connected to the two electronic connections, wherein the pair of connecting terminals comprises a housing, the housing contains a first connecting terminal for a first connecting wire and a second connecting terminal for a second connecting wire, wherein, in operation the relay is capable to close or interrupt a circuit between the first connecting terminal and the second connecting terminal, wherein the first connecting terminal is spaced apart from the receptacle by a first distance in a first direction, characterized in that the second connecting terminal is spaced apart from the receptacle by a second distance in the first direction, wherein the first distance and the second distance are different.

2. The relay socket according to claim 1, characterized in that the first connecting terminal and the second connecting terminal are arranged one behind the other with respect to the first direction.

3. The relay socket according to claim 1, characterized in that said device has a mounting device for mounting on a mounting rail, wherein when the device is mounted on the mounting rail the first direction is oriented at a right angle to a longitudinal direction of the mounting rail.

4. Arrangement comprising at least two devices according to claim 1, and a mounting rail characterized in that the relay sockets are mounted parallel to one another on the mounting rail, wherein the second direction is oriented in a longitudinal direction of the mounting rail, and wherein two adjacent relay sockets are in contact with one another.

5. The relay socket according to claim 1, characterized in that the first connecting terminal of the pair of connecting terminals comprises a spring for clamping tight the connecting wire.

6. The relay socket according to claim 5, characterized in that the spring is embodied as a leg spring with a first and a second edge, wherein the first edge projects in a secured fashion into a receptacle space of the first connecting terminal for the connecting wire, and a second spring connects in a sprung fashion into said receptacle space, in order to clamp tight the connecting wire.

7. The relay socket according to claim 6, characterized in that when a connecting wire is clamped tight the second edge the second edge can be moved at least partially out of the receptacle space.

8. The relay socket according to claim 6, characterized in that said relay socket comprises a duct which is assigned to a first spring connecting terminal and via which the second edge can be moved at least partially out of the receptacle space by means of a rod-shaped element.

9. The relay socket according to claim 1, characterized in that the second connecting terminal is embodied in an analogous fashion to the first connecting terminal.

10. The relay socket according to claim 9, characterized in that the first connecting terminal is arranged point-symmetrically with respect to the second connecting terminal.

11. The relay socket according to claim 1, characterized in that the pair of connecting terminals with the first connecting terminal and the second connecting terminal is embodied as a separate unit from the base body.

12. The relay socket according to claim 1, characterized in that said relay socket comprises a holding means for holding the relay in the receptacle, wherein the receptacle has a receptacle width in a second direction at a right angle to the first direction, wherein the receptacle width corresponds to an overall width of the relay socket in the second direction.

13. The relay socket according to claim 12, characterized in that the holding means has a holding means width in the second direction, wherein the holding means width is less than or equal to the receptacle width.

14. The relay socket according to claim 12, characterized in that the holding means is embodied in a pivotable fashion, wherein in a first pivoted state of the holding means the receptacle is released, and in a second pivoted state, different from the first, of the holding means a relay can be held in the receptacle.

15. The relay socket according to claim 14, characterized in that the holding means is mounted on the base body so as to be pivotable in a plane at a right angle to the second direction.

16. The relay socket according to claim 11, characterized in that the pair of connecting terminals is embodied as a plug-in unit which can be plugged into the base body.

17. The relay socket according to claim 16, characterized in that the pair of connecting terminals can be latched into the base body.

18. The relay socket according to claim 11, characterized in that the housing comprises two half-shells.

19. The relay socket according to claim 18, characterized in that the two half-shells are produced by means of an injection molding method.

* * * * *